United States Patent [19]

Bennett et al.

[11] Patent Number: 5,046,477

[45] Date of Patent: Sep. 10, 1991

[54] GAS COOK-TOP WITH GLASS TOP

[75] Inventors: James L. Bennett; John D. Robeson, both of Cedar Rapids; Ralph E. Biddle, Iowa City, all of Iowa

[73] Assignee: Amana Refrigeration Inc., Amana, Iowa

[21] Appl. No.: 635,080

[22] Filed: Dec. 28, 1990

[51] Int. Cl.[5] ..... F24C 3/00

[52] U.S. Cl. ..... 126/39 B; 126/39 R; 126/39 H; 126/214 A

[58] Field of Search ..... 126/214 A, 214 R, 215, 126/39 R, 39 B, 39 H

[56] References Cited

U.S. PATENT DOCUMENTS 3,724,441 3/1973 Finley ..... 126/214 R 4,971,024 11/1990 Albon et al. ..... 126/39 R

*Primary Examiner*—Carroll B. Dority

*Attorney, Agent, or Firm*—William R. Clark; Richard M. Sharkansky

[57] ABSTRACT

A gas cook-top with a glass top wherein each of a plurality of burners has a neck portion with a flange that seats down on a gasket thereby sealing the burner to the glass top. A collar surrounds the neck portion of each burner. Brackets are positioned below the glass top and support the burners independent of the glass top. A grate covers a pair of burners and has locator rod members that encircle portions of the respective collars, thereby fixedly locating the grate on the glass top.

16 Claims, 3 Drawing Sheets

GAS COOK-TOP WITH GLASS TOP

BACKGROUND OF THE INVENTION

The field of the invention generally relates to gas cook-top appliances, and more particularly relates to such appliances that have glass or ceramic top panels to which the gas burners are sealed.

As is well known, electric cook-top appliances having glass or ceramic top panels have been used for many years, and they have been popular for a variety of reasons. For example, many people like the shiny smooth and modern appearance of a glass top surface. Also, a glass or ceramic top is generally easy to clean. Further, if the heating elements are sealed to the glass top, spills are retained on the top surface so that they are relatively easy to clean.

More recently, glass top panels have been used for gas cook-tops. More specifically, a commercially available gas cook-top has a glass top with a plurality of relatively large apertures. Each of the gas burners is centrally mounted to a downwardly recessed metal pan which has a rim suspended by a peripheral portion of a respective one of the apertures in the glass top. Thus, the metal pans provide mounting apparatus for the burners. The glass is a relatively low temperature glass such as, for example, 450° F. glass, so the metal pans also serve to limit the temperature to which the glass is subjected. Further, the metal pans function to locate burner grates that support cooking utensils above the burners.

The above described arrangement, however, has some drawbacks. More specifically, the metal pans add to the cost of the product. Also, spills, dirt, and grease may accumulate in the metal pans, and such accumulations or spoils are difficult to clean. Further, if a cooking utensil with a large bottom is used, the combustion products can be deflected outwardly heating the glass top to a temperature above its safe limit.

SUMMARY OF THE INVENTION

It is a primary object of the invention to provide improved apparatus and method for mounting gas burners to a glass or ceramic top panel.

It is also an object to provide apparatus for fixing the location of grates on a gas cook-top without using recessed metal pans.

It is a further object to provide apparatus for supporting the gas burners in the event that the glass top is damaged or broken.

A gas cook-top comprises a glass top panel having at least first and second apertures with first and second gas burners respectively extending up therethrough. In accordance with the invention, the gas cook-top further comprises a grate adapted for supporting cooking utensils above the respective burners wherein the grate is supported on the glass top panel and has first and second locator members each surrounding at least a portion of a respective one of the first and second burners wherein the horizontal alignment of the grate on the glass top panel is fixed by abutment with the first and second burners. Glass is intended to be used in a broad sense to include a wide variety of glass and glass ceramic type materials. It is preferable that the grate comprise a plurality of interconnected rods such as metal rods that are welded together and enamel coated. It is also preferable that the first and second burners be substantially circular and that each of the respective locator members comprise a rod which encircles a portion of a respective one of the first and second burners. It may also be preferable that the first and second burners each comprises a neck having a flange spaced above the glass top panel by a gasket, and that the cook-top further comprise first and second collars each covering a respective flange and gasket. In such embodiment, each of the encircling rod locator members abuts a respective one of the first and second collars.

With such arrangement, the grate is located on the smooth glass top panel and is prevented from rotating even though the burners are sealed to the glass top panel and no burner pans are used. That is, the grate has rods arranged such that they encircle neck portions of two burners thereby fixing the location of the grate.

The invention may also be practiced using a gas cook-top comprising a substantially flat glass top panel having at least one aperture, a metal box including side walls and a bottom positioned below the glass top panel, a gas burner projecting from the box up through the aperture in the glass top panel, and means comprising a bracket connected to the metal box for supporting the burner independent of the glass top panel. For example, the supporting means may comprise a bracket connected to opposing side walls of the box. Also, a resilient gasket may preferably be disposed between the bracket and the glass panel to prevent damage or breakage during shipment.

With such arrangement, the glass panel can be broken during operation and the burner is still independently supported.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 1:
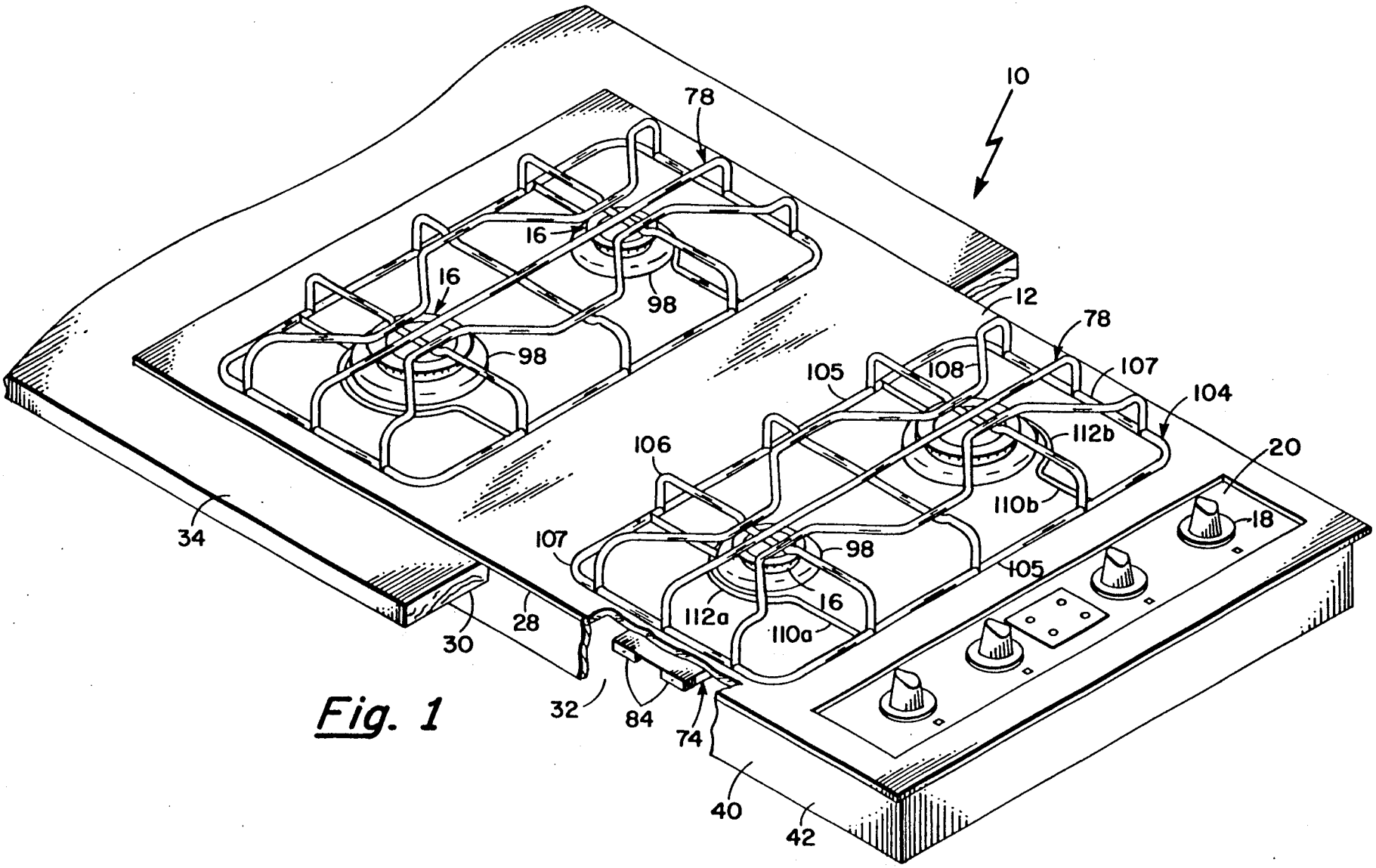
FIG. 1 is a perspective view of a gas cook-top.
Figure 3:
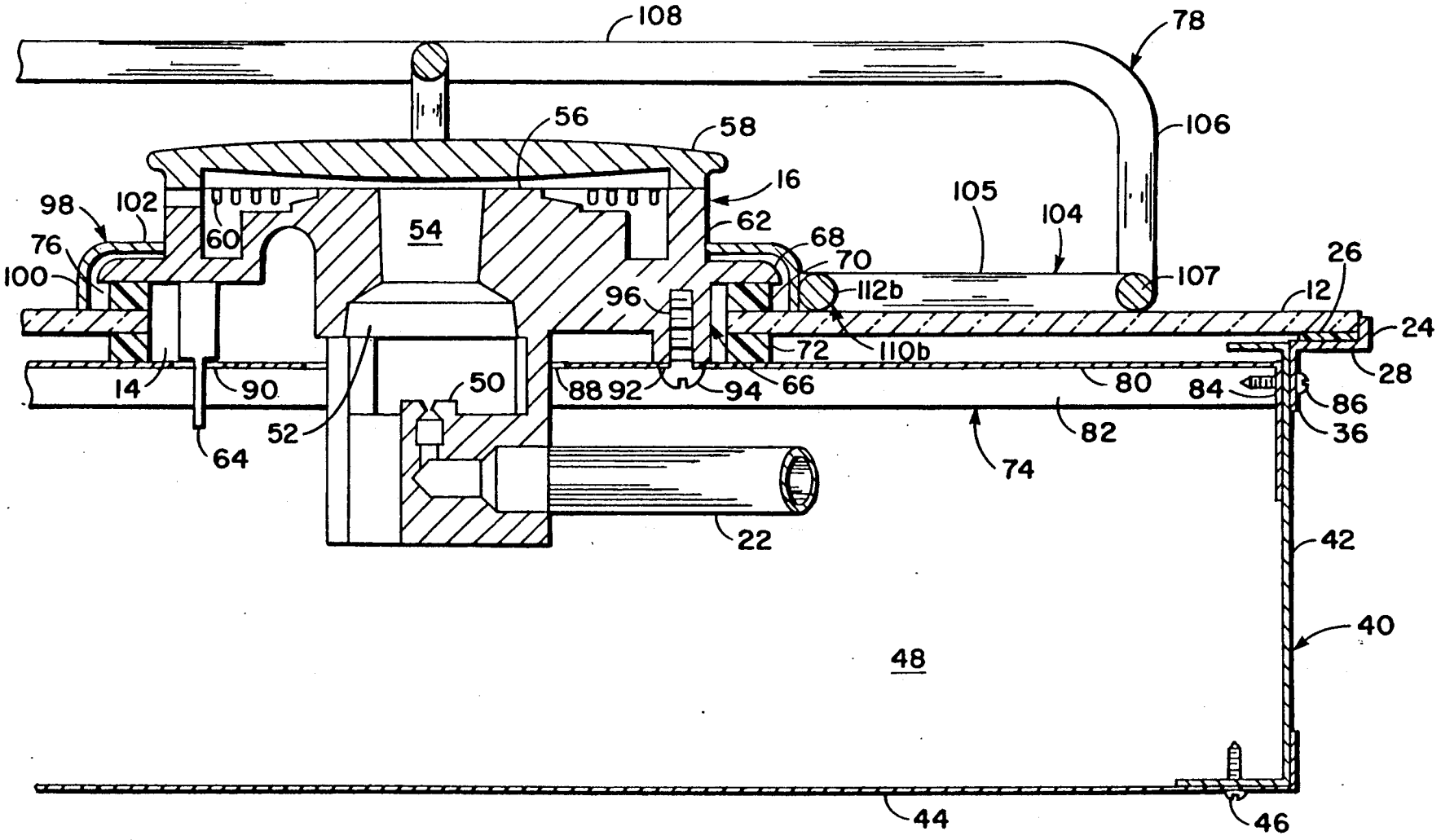
FIG. 3 is a side sectioned view of one of the burners shown mounted in the cook-top.

Referring to the drawings wherein like reference numerals refer to like parts throughout the several views, gas cook-top 10 here includes a flat glass panel 12 which functions as the main top or top surface of the appliance. Glass panel 12, which also may be made from other materials such as, for example, ceramic is a high temperature material such as Ceran as available from Schott Glaswerke of Mainz, West Germany. Such material preferably is resistant to damage from temperature of approximately 1000° F. As shown in FIG. 3, glass panel 12 here has a plurality of circular apertures 14 for mounting burners 16, and also has openings (not shown) for passing shafts (not shown) that couple control knobs 18 of control panel 20 to respective suitable conventional gas controls (not shown) which typically include a gas manifold and gas valves that connect to respective gas pipes 22 that lead to the respective burners 16. Glass panel 12 sits in a metal frame 24 and is here bonded by a suitable adhesive 26 such as RTV. Frame 24 has a horizontally extending lip 28 that here rests on a peripheral portion 30 of a drop-in opening 32 of a counter top 34 as shown in FIG. 1. Alternatively, gas cook-top 10 could be fabricated as the main top of a free standing range.

As shown best in FIG. 3, frame 24 has a downwardly extending flange 36 that connects with to metal box 40 using suitable fasteners such as screws. Box 40 includes four sidewalls 42 that are connected to bottom 44 with screws 46. Box 40 forms a compartment 48 in which suitable controls (not shown) and interconnecting pipes 22 are located. Compartment 48 provides an environment which is isolated from rapid pressure changes such as might be caused by opening or closing a cabinet door. Thus, the drawing of primary combustion air into burners 16 is not significantly effected by such actions as opening or closing a cabinet door.

Figure 2:
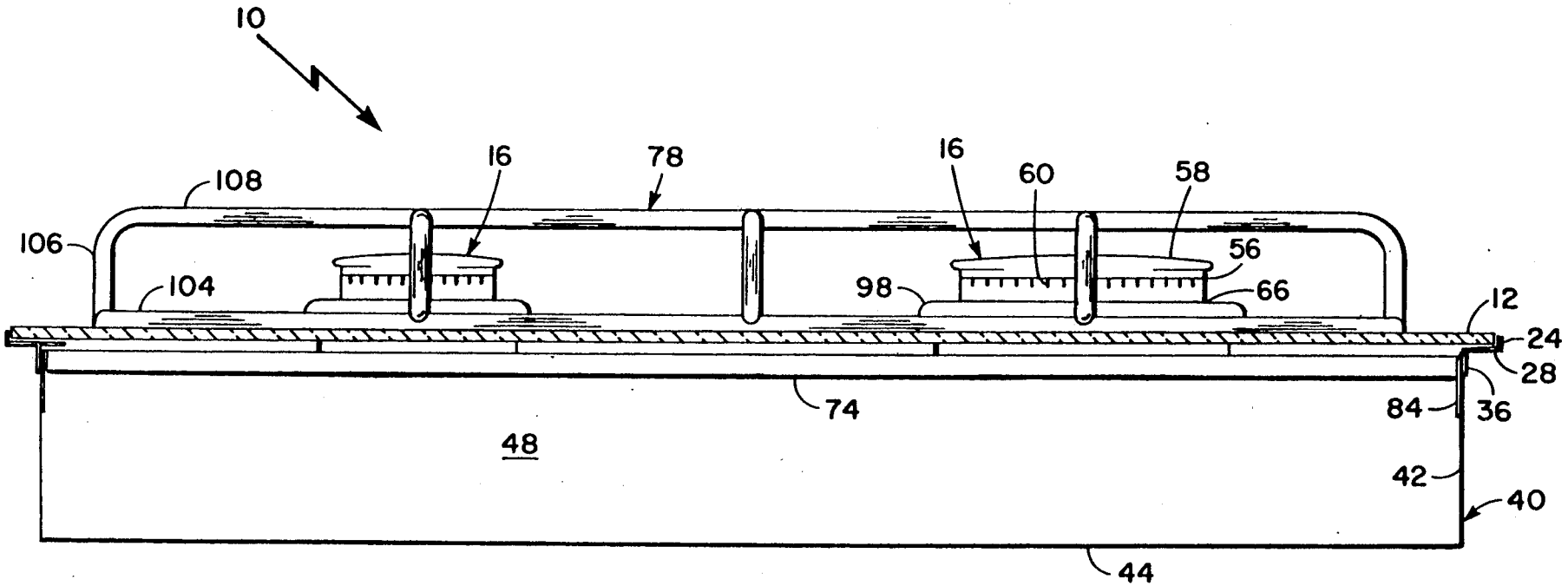
FIG. 2 is a sectioned side view of the gas cook-top.

FIG. 3 shows a cross-sectional view of burner 16 mounted within aperture 14. As shown in FIGS. 1 and 2, burners 16 have different sizes to accommodate cooking utensils of different sizes, and in conventional manner, there are two large and two small burners with the like sizes being located diagonally from each other. FIG. 3 depicts a large burner 16, but it is understood that a small burner would be mounted in the same manner. Burner 16 is a suitable burner such as available from Robert Shaw Controls Company of Youngwood, Pa. In conventional manner, gaseous fuel is received from gas pipe 22 and issues from orifice plate 50 from where it is directed into venturi 52 such that primary combustion air is drawn into mixing chamber 54. The fuel/air mixture then moves upwardly in burner head 56 which is covered by removable cap 58, and then moves outwardly and issues from burner ports 60 cut in outer wall 62 of burner head 56. A conventional igniter 64 which is conventionally coupled to an electric source then ignites the fuel/air mixture. Secondary air is drawn radially inward from the sides of burners 16.

Burner 16 has a neck portion 66 which extends up through aperture 14 and also includes an outwardly directed peripheral flange 68 that is larger than the respective aperture 14. Flange 68 contacts a high temperature annular silicon gasket 70 or a ring. A like gasket 72 is located on the underside of glass panel 12 and is positioned between glass panel 12 and burner mounting bracket 74. Gasket 70 provides several functions. First, gasket 70 provides a seal between burner 16 and glass panel 12 so that spills are retained on the top surface of glass panel 12 so that they are easy to clean. In other words, liquid spills are prevented from dripping from the top surface of glass panel 12 down through apertures 14. Second, gasket 70 has a predetermined thickness such as, for example, approximately 0.2 inches and thereby raises the burner ports 60 upwardly by a like distance. Such raising has been found to improve the flame characteristics by permitting more vertical spacing between ports 60 and glass panel 12 for secondary combustion air to flow radially inwardly. As will be described hereinafter, the raising also provides a collar region 76 for abutting grate 78. Third, gaskets 70 and 72 are preferably made of a resilient material that provides shock absorption to prevent damage or breakage of glass panel 12 during shipping.

Burner mounting bracket 74, which has a flat upper panel 80 and sides 82 to provide rigidity, extends across box 40 and has feet 84 as shown in FIG. 1 that are attached to opposing sidewalls 42 by suitable fasteners such as screws 86. Flat panel 80 is spaced below glass panel 12, and has openings 88 for passing burner neck portion 66, small holes 90 for passing igniter 64, and screw holes 92 for receiving screws 94 as shown in FIG. 3. More specifically, burner 16 has mounting bores 96 for screws 94 which are inserted up through screw holes 92 and threaded into bores 96 so that burner 16 is supported by burner mounting bracket 74 which is anchored to sidewalls 42 of box 40. Thus, even in the event that glass panel 12 is cracked or broken during operation of burners 16, burners 16 are still held in normal operating alignment because burners 16 are supported independent of glass panel 12.

Neck portion 66 of burner 16 may also preferably include a removable metal collar 98 that sits on glass panel 12 and has a vertical section 100 that bends inwardly at the top forming horizontal cover section 102 that abuts the side of burner 16. Collar 98 may be desirable for decorative reasons in that it covers up gasket 70 and also may be painted to the same or complimentary color as burner 16. Also, as will be described, vertical section 100 provides a vertical surface used to abut and locate grates 78.

Grate 78 is used in conventional manner to support cooking utensils above burners 16. Grate 78 is a unitary part and here includes a plurality of interconnected metal rods that are coated or enameled. Grate 78 includes an outer peripheral support rod 104 or base rod that rests on glass panel 12 and is made up of opposing side segments 105 and opposing end segments 107. A plurality of upstanding segments 106 are connected to peripheral support rod 104, and upstanding segments interconnect with horizontal segments 108 that are arranged in a predetermined pattern so as to support cooking utensils above burners 16. One grate 78 is used for two burners 16, and each grate includes two lateral locator members 110*a* and 110*b* that are connected between side segments 105 of base rod 104, and have arcuate segments 112*a* and 112*b* configured and spaced so as to respectively encircle portions of neck portions 66 of two respective burners 16. In such manner, grate 78 is located in a fixed position on glass panel 12 over burners 16 even though glass panel 12 has a flat and smooth top surface without any grate locating structures. Rather, burners 16 are used to fix the location of grate 78 and also to prevent grate 78 from being rotated in its horizontal plane.

Although locator members 110*a* and 110*b* could be configured to locate grate 78 over two large or two small burners 16, here grate 78 has one arcuate segment 112*a* adapted to conform with a small burner 16 and another arcuate segment 112*b* adapted to conform with a large burner 16. The arcuate segments 112*a* and 112*b* should be large enough so as to prevent rotation of grate 78, and may in an alternate embodiment completely encircle respective burners 16. Also, locator members 110*a* and 110*b* are here shown on the opposite sides of respective burners 16, but they could also be positioned on the inside. As shown best in FIG. 3, collars 98 provide a vertical section 100 against which arcuate sections 112*a* and 112*b* abut. In an alternate embodiment, collar 98 could be eliminated, but burner 16 would preferably provide some corresponding neck portion against which arcuate sections 112*a* and 112*b* could abut. For example, burner 16 could be redesigned to have a downwardly directed outer lip on flange 68 that could provide a surface for contacting arcuate sections 112*a* and 112*b*.

In assembly, the sidewalls 42 of box 40 are initially attached together. Next, two burner mounting brackets 74 are attached across opposing sidewalls 42. In a separate assembly process, RTV is deposited on metal frame 24 to provide adhesive 26, and then glass panel 12 is lowered into frame 24 on top of the RTV. Next, the frame 24 is attached to the assembled sidewalls 42 after gaskets 72 are positioned between glass panel 12 and burner mounting brackets 74. The gaskets 70 are next positioned surrounding apertures 14 on the top of glass panel 12, and the burners 16 are inserted down through apertures 14 from the top. Screws are then driven up through screw holes 92 in burner mounting bracket to attach burner 16 to burner mounting bracket 74. After connecting the controls (not shown) and the interconnecting gas pipes 22, bottom 44 is attached to sidewalls 42 to complete box 40. Then, before installation, collars 98 are seated around the respective burners 16, and the grates 78 are seated on the glass panel 12 thereby being fixedly located by collars 98.

This concludes the description of the preferred embodiments. A reading of it by those skilled in the art will bring to mind many alterations and modifications without departing from the spirit and scope of the invention. Therefore, it is intended that the invention be limited only by the appended claims.

What is claimed is:

1. A gas cook-top comprising:

a glass top panel having at least first and second apertures;

first and second gas burners extending up through said respective first and second apertures in said glass top panel;

a grate adapted for supporting cooking utensils above said respective burners, said grate being supported on said glass top panel and having first and second locator members each surrounding at least a portion of a respective one of said first and second burners wherein the horizontal alignment of said grate on said glass top panel is fixed by abutment with said first and second burners.

2. The gas cook-top recited in claim 1 wherein said grate comprises a plurality of interconnected rods.

3. The gas cook-top recited in claim 2 wherein each of said first and second burners is substantially circular and each of said locator members comprises a rod encircling a portion of a respective one of said first and second burners.

4. The gas cook-top recited in claim 3 wherein each of said first and second burners comprises a neck having a flange spaced from said glass top panel by a gasket, said gas cook-top further comprising first and second collars each covering respective ones of said flanges and gaskets.

5. The gas cook-top recited in claim 4 wherein each of said encircling rod locator members abuts a respective one of said first and second collars.

6. A gas cook-top appliance comprising:

a substantially flat glass top panel having at least first and second apertures;

first and second gas burners each having a burner head positioned above said glass top panel and a neck extending down through a respective one of said first and second apertures to a source of gaseous fuel; and a rod grate adapted for supporting cooking utensils above said first and second burners, said grate comprising a base rod having side segments and end segments seated on said glass top panel and surrounding both said first and second burners, said grate further comprising upstanding rod segments spacing a substantially horizontal predetermined pattern of rods above said burners, said grate further comprising means adjacent said respective necks of said first and second burners for locating said grate on said glass top panel with respect to said first and second burners.

7. The glass cook-top appliance recited in claim 6 wherein said locating means comprises first and second locator rods spanning across between said side segments of said base rod, said first and second locator rods each having an arcuate segment adapted to encircle a portion of a respective one of said necks of said first and second burners wherein horizontal motion and rotation of said grate on said glass top panel is prevented by engagement with said first and second burners.

8. The gas cook-top appliance recited in claim 7 wherein each of said respective necks comprises a gasket sandwiched between said glass top panel and a flange of said neck, each of said necks further comprising a collar covering said flange and said gasket wherein said first and second locator rods each encircle a portion of a respective one of said collars.

9. A glass cook-top appliance comprising:

a substantially flat glass top panel having at least first and second circular apertures;

first and second gas burners each having a neck extending through a respective one of said first and second apertures, each of said necks comprising a flange larger than the respective one of said first and second apertures and a gasket sandwiched between the respective one of said flanges and said glass top panel, each of said necks further comprising a collar surrounding the respective one of said flanges and having a substantially circular horizontal wall; and a rod grate adapted for supporting cooking utensils above said first and second burners, said grate comprising a base rod having side segments and end segments seated on said glass top panel and peripherally surrounding both said first and second burners, said grate further comprising upstanding rod segments spacing a horizontal predetermined rod pattern above said burners, said grate further comprising means for locating said grate on said glass top panel with respect to said first and second burners and for preventing said grate from being rotated with respect to said first and second burners, said locating and preventing means comprising first and second locator rods connected between said side segments of said grate base, said first and second locator rods each comprising an arcuate portion encircling and abutting portions of a respective one of said circular horizontal walls of said collars.

10. A gas cook-top comprising:

a substantially flat glass top panel having at least one aperture;

a metal box including side walls and a bottom positioned between said glass top panel;

a gas burner projecting from said box up through said aperture in said glass top panel;

means comprising a bracket connected to said metal box for supporting said burner independent of said glass top panel; and wherein said burner comprises a neck portion with a flange above said glass top panel, said cook-top further comprising a first gasket sandwiched between said flange and said glass top panel, said gas cook-top further comprising a second gasket located between said glass top panel and said bracket.

11. The gas cook-top recited in claim 10 wherein said support means comprises a bracket connected to opposing side walls of said box and spanning across said box between said opposing side walls.

12. The gas cook-top recited in claim 11 wherein said bracket comprising an opening through which said burner extends, said burner being attached to a portion of said bracket peripheral to said opening.

13. The gas cook-top recited in claim 10 wherein said first and second gaskets are made of a high temperature resilient material.

14. A method of fabricating a gas cook-top, comprising the steps of:

connecting together side walls of a box;

attaching a bracket having an opening between opposing ones of said side walls;

connecting a glass top panel having at least one aperture to a frame;

positioning a first gasket around said aperture on the upper side of said glass top panel;

passing a gas burner with a neck portion having a flange down through said aperture so that said flange sits on said gasket sealing said burner to said glass top panel;

positioning a second gasket around said opening on the upper side of said bracket;

seating and attaching said frame onto side walls of said box so that said burner extends down through said opening of said bracket and said second gasket is disposed between said glass top panel and said bracket;

attaching a fuel line to said burner; and attaching a bottom of said box to said side walls.

15. The method recited in claim 14 further comprising the step of mounting at least a second burner to said gas cook-top.

16. The method recited in claim 15 further comprising the step of seating a grate on said glass top panel and locating said grate by abutment with said burners.

* * * * *